US010167152B2

(12) United States Patent
Widsten et al.

(10) Patent No.: US 10,167,152 B2
(45) Date of Patent: Jan. 1, 2019

(54) FOLDED MEDIA DETECTION AND PROCESSING

(71) Applicant: NCR Corporation, Duluth, GA (US)

(72) Inventors: Benjamin T. Widsten, Kitchener (CA); Frank B. Dunn, Waterloo (CA); Jason Michael Gillier, Waterloo (CA)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/197,968

(22) Filed: Jun. 30, 2016

(65) Prior Publication Data

US 2018/0002131 A1 Jan. 4, 2018

(51) Int. Cl.

| | |
|---|---|
| ***B65H 7/06*** | (2006.01) |
| ***B65H 43/04*** | (2006.01) |
| ***B65H 3/06*** | (2006.01) |
| ***B65H 7/18*** | (2006.01) |
| ***B65H 7/20*** | (2006.01) |
| ***B65H 7/12*** | (2006.01) |

(52) U.S. Cl.

CPC ..... *B65H 7/06* (2013.01); *B65H 3/06* (2013.01); *B65H 7/125* (2013.01); *B65H 7/18* (2013.01); *B65H 7/20* (2013.01); *B65H 43/04* (2013.01); *B65H 2511/13* (2013.01); *B65H 2511/414* (2013.01); *B65H 2553/30* (2013.01); *B65H 2701/1912* (2013.01)

(58) Field of Classification Search

CPC ... B65H 3/06; B65H 7/06; B65H 7/12; B65H 7/125; B65H 7/18; B65H 7/20; B65H 43/04; B65H 29/62; B65H 2553/30

See application file for complete search history.

(56) References Cited

U.S. PATENT DOCUMENTS

| | | | | |
|---|---|---|---|---|
| 4,494,747 | A * | 1/1985 | Graef | B65H 3/0638 221/21 |
| 8,307,989 | B2 * | 11/2012 | Takai | G07D 7/164 194/206 |
| 2004/0100018 | A1 * | 5/2004 | Phinney | B65H 7/125 271/262 |
| 2005/0133990 | A1 * | 6/2005 | Mukai | B65H 7/06 271/258.01 |
| 2005/0228535 | A1 * | 10/2005 | Sinnonis | B65H 7/125 700/228 |
| 2007/0007103 | A1 * | 1/2007 | Takai | G07D 11/003 194/206 |
| 2009/0278307 | A1 * | 11/2009 | Skinner | B65H 3/0638 271/273 |
| 2011/0317230 | A1 * | 12/2011 | Tanaka | B65H 3/063 358/498 |

* cited by examiner

*Primary Examiner* — Prasad V Gokhale

(74) *Attorney, Agent, or Firm* — Schwegman, Lundberg & Woessner

(57) ABSTRACT

A media separator module of a valuable media depository is selectively controlled to detect folded media and selectively eject the media or preform double feed recovery processing based on a fold type detected for the media.

23 Claims, 12 Drawing Sheets

FOLDED MEDIA DETECTION AND PROCESSING

BACKGROUND

Media handing devices that process multiple document bunches must separate the documents for individual processing downstream within the media handling devices. A media separator is a component of the media handling devices. Typically, the media separator uses an ultrasonic sensor for detecting any overlapping documents.

The ultrasonic sensor reports when a detection is made as to whether the ultrasonic sensor detects: i) a clear condition, ii) a single condition, or iii) a double condition. A clear condition indicates that no document is detected by the ultrasonic sensor. A single condition indicates that one document is detected by the ultrasonic sensor. A double condition indicates one or multiple documents are detected by the ultrasonic sensor. Additionally, in situations where overlapping documents cover half of the ultrasonic sensor while the other half of the ultrasonic sensor is clear, the ultrasonic sensor will report a single condition.

A double feed recovery is performed by the media separator to separate any detected overlapping documents within the media separator. However, performance of the double feed recovery reduces throughput of document processing within the media handling device.

For purposes of maintaining adequate document processing throughput within the media handling device, the double feed recovery processing is not instantly performed when the ultrasonic sensor reports a double condition; this allows for a certain amount of time to give the documents a chance to properly separate within the media separator. However, if the double condition remains after the elapsed period of time, the double feed recover is performed. But, if the ultrasonic sensors report a single or clear condition before the elapsed period of time, the documents are assumed to have properly separated from one another and double feed recovery is not performed and document throughput within the media handling device is maintained.

One significant issue with double feed recovery is that folded documents can fool the double feed recovery processing, such that a document may appear as being successfully separated but in reality a fold in the document has passed the ultrasonic sensor. The folded documents can jam downstream processing within the media handling device and result in manual service calls to remedy the jam, and during such time until the jam is resolved the media handling device is out of service.

SUMMARY

In various embodiments, methods and a system for folded media detection and processing within a valuable media depository are provided.

According to an embodiment, a method for folded media detection and processing is presented. Specifically, and in one embodiment, a folded media condition is detected within a media separator module for an item of media. Next, a determination is made as to whether to eject the item from the media separator module and whether to perform double feed recovery processing on the item within the media separator module based on the detected folded media condition.

DETAILED DESCRIPTION

Figure 1A:
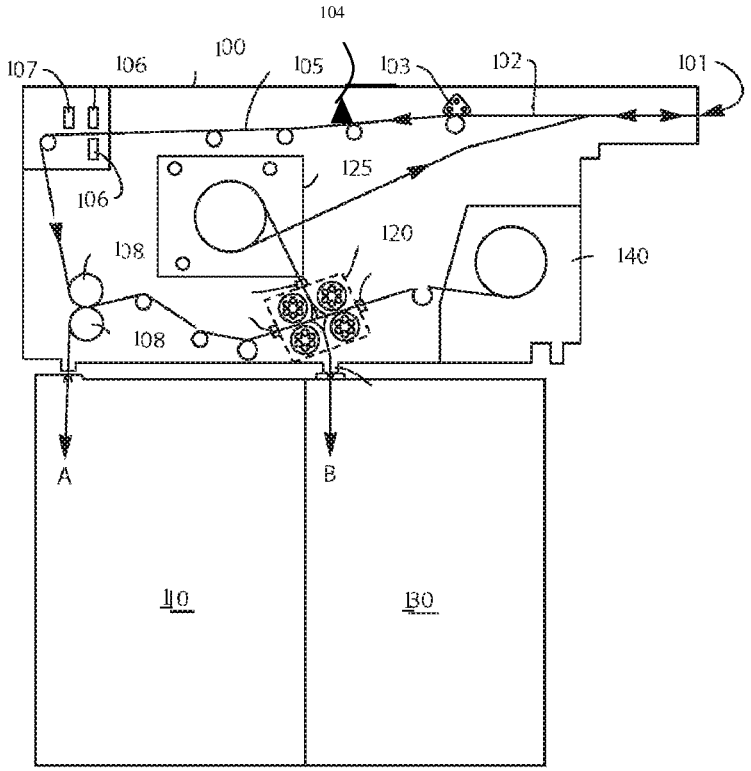
FIG. 1A is a diagram depicting a deposit module of a Self-Service Terminal (SST) having a media separator module, according to an example embodiment.

FIG. 1A is a diagram depicting a one-sided view of a valuable media depository 100, according to an example embodiment (also referred to as a deposit module). It is to be noted that the valuable media depository is shown with only those components relevant to understanding what has been added and modified to a conventional depository for purposes of providing folded media (document) detection and processing within the depository 100.

The depository 100 is suitable for use within an Automated Teller Machine (ATM), which can be utilized to process deposited banknotes and checks (valuable media as a mixed bunch if desired). The deposit module 100 has an access mouth 101 (media or document infeed) through which incoming checks and/or banknotes are deposited or outgoing checks and/or banknotes are dispensed. This mouth 101 is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport path 102 away from the mouth 101 in a substantially horizontal direction from right to left shown in the FIG. 1A. They then pass through a novel separator module 103 (discussed in detail below with reference to the FIGS. 1B-1L, 2, and 3) and from the separator 103 to a deskew module 104 along another pathway portion 105, which is also substantially horizontal and right to left. The items are now de-skewed and aligned for reading by imaging cameras 106 and a Magnetic Ink Character Recognition (MICR) reader 107.

Items are then directed substantially vertically downwards to a point between two nip rollers 108. These nip rollers cooperate and are rotated in opposite directions with respect to each other to either draw deposited checks and/or banknotes inwards (and urge those checks and/or banknotes towards the right hand side in the FIG. 1A), or during another mode of operation, the rollers can be rotated in an opposite fashion to direct processed checks and/or banknotes downwards in the direction shown by arrow A in the FIG. 1A into a check or banknote bin 110. Incoming checks and/or banknotes, which are moved by the nip rollers 108 towards the right, enter a diverter mechanism 120. The diverter mechanism 120 can either divert the incoming checks and/or banknotes upwards (in the FIG. 1A) into a re-buncher unit 125, or downwards in the direction of arrow B in the FIG. 1A into a cash bin 130, or to the right hand side shown in the FIG. 1A into an escrow 140. Items of media from the escrow 140 can selectively be removed from the drum and re-processed after temporary storage. This results in items of media moving from the escrow 140 towards the left hand side of the FIG. 1A where again they will enter the diverter mechanism 120. The diverter mechanism 120 can be utilized to allow the transported checks (a type of valuable media/document) and/or banknotes (another type of valuable media/document) to move substantially unimpeded towards the left hand side and thus the nip rollers 108 or upwards towards the re-buncher 125. Currency notes from the escrow can be directed to the re-buncher 125 or downwards into the banknote bin 130.

As used herein, the phrase "valuable media" refers to media of value, such as currency, coupons, checks, negotiable instruments, value tickets, and the like.

For purposes of the discussions that follow with respect to the FIGS. 1A-1H, "valuable media" is referred to as currency and the "valuable media depository" is referred to as a "depository." Additionally, valuable media may be referred to as a "document" herein.

Moreover, the phrase "folded media" or "folded document" as used herein refers to any valuable media/document that is folded upon itself at a tail edge, front edge, or somewhere near a middle of the document within the depository 100 within the media separator module 103.

Figure 1B:
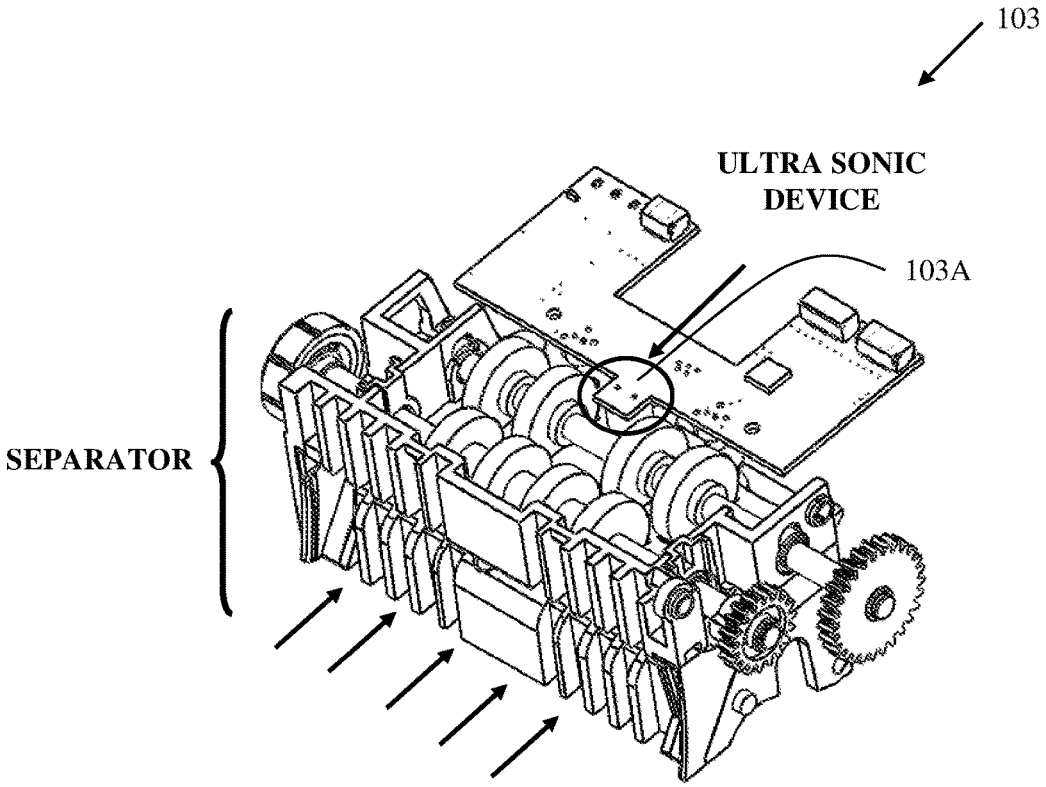
FIG. 1B is a diagram depicting a media separator module from a top-bottom perspective, according to an example embodiment.

FIG. 1B is a diagram depicting a media separator module 103 from a top-bottom perspective, according to an example embodiment.

Only those components of the media separator module 103 that are necessary for understanding the teachings presented herein are labeled in the FIGS. 1B-1L that follow.

Visible in the top-to-bottom perspective of the media separator module 103 in the FIG. 1B is a top (from the perspective of the document's travel through the media separator module 103) or a first ultrasonic sensor 103A.

Figure 1C:
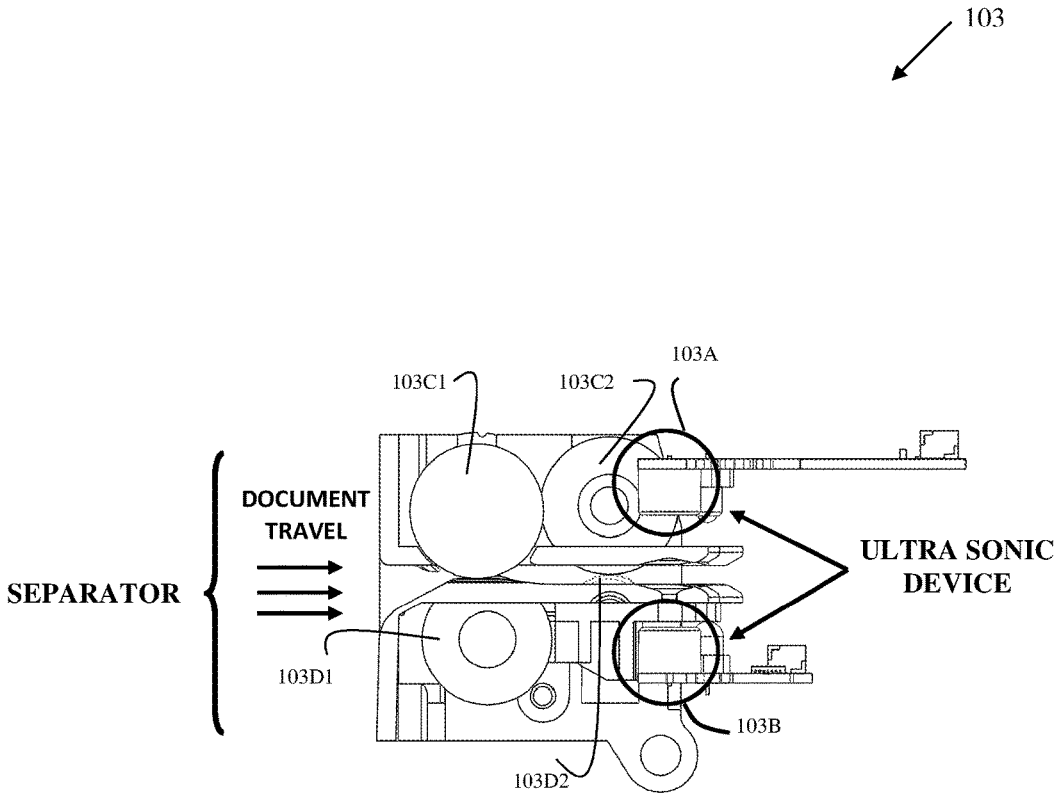
FIG. 1C is a diagram depicting a cross-section perspective of media separator module, according to an example embodiment.
Figure 1D:
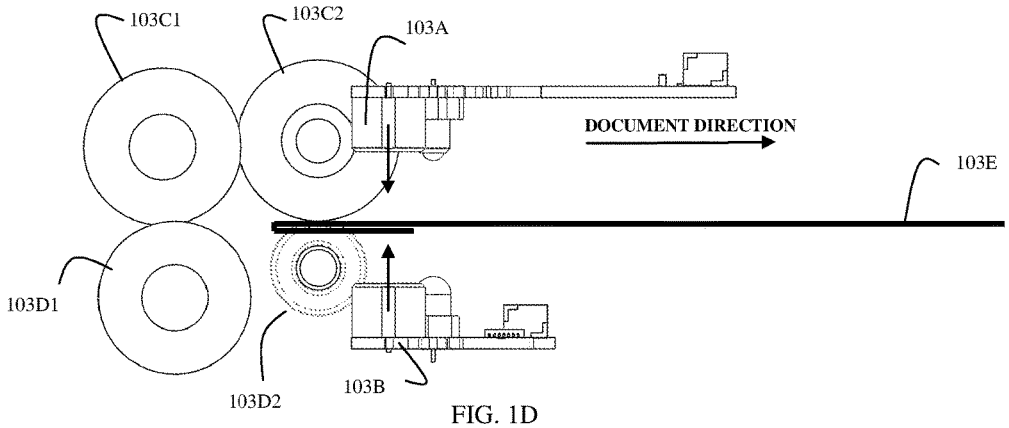
FIG. 1D is a diagram depicting a tail edge document fold within a media separator module, according to an example embodiment.

FIG. 1C is a diagram depicting a cross-section perspective of media separator module 103, according to an example embodiment.

Visible in the cross-section perspective of the media separator module in the FIG. 1C is: i) the first (top) ultrasonic sensor 103A which opposes a second (bottom) ultrasonic sensor 103B (the document passes through and between the first (top) ultrasonic sensor 103A and the second (bottom) ultrasonic sensor 103B, and ii) transport drives including a pair of adjacent upper (top) drives 103C1 and 103C2 which oppose a pair of adjacent lower (bottom) drives 103D1 and 103D2 (the document is urged along a path of travel between the two pairs of transport drives (103C1, 103C2, 103D1, and 103D2) and the ultrasonic sensors 103A and 103B.

During conventional document separation processing, a conventional separator module would detect one of three conditions reported from the conventional ultrasonic sensors. A clear condition indicating that there is no document detected between the ultrasonic sensors; a single condition indicating that a single document is detected between the ultrasonic sensors; and double condition indicating one or multiple documents are detected between the ultrasonic sensors. The conventional separator module pauses for a small configured amount of time when the double condition is detected and after such pause takes another reading from the ultrasonic sensors to see if the double condition has resolved itself. When the double condition is not resolved, the conventional separator module performs a double feed recovery attempt to separate the potential multiple documents within the separator module through selective activation of the conventional transport drives. After a configured amount of unsuccessful attempts to automatically separate the multiple documents, the conventional separator module ejects the documents from the conventional separator module. Thus, the conventional separator module has three modes of operation: a normal mode (where no dual document processing is needed), a dual recovery mode (where dual documents are detected and separation processing is performed, and an ejection mode (where documents after having attempted the dual recovery processing fail to separate and the documents are ejected back out an entry point in the conventional separator module).

As will be discussed more completely herein and below, the media separator module 103 is configured to detect a variety of different types of folds for a single document being processed within the media separator module 103 and further configured to perform double feed recovery processing and/or ejection processing on the document based on the different types of detected folds for the single document. This provides for folded document detection and optimal and timely document throughput processing of documents through the media separator module 103. Moreover, in some situations, one or more transport drives (103C1, 103C2, 103D1, and/or 103D2) are activated in a manner that is different from that which has been done conventionally for document double feed recovery and document ejection in response to the detected folded document detection; thereby, providing a novel fourth mode of operation for the media separator module 103.

A variety of folded document detection conditions and media separator module 103 processing is now discussed with reference to the FIGS. 1D through 1L.

Tail Edge Document Fold Detection and Processing

As a document 103E is urged through the media separator module 103, the ultrasonic sensors 103A and 1038 provide readings for the document. The start of the document 103E is noted through ultrasonic sensor readings and readings are reported as the document travels through the media separator module 103. The ultrasonic sensors 103A and 103B report conditions for the document 103E as the document 103E is being processed through the media separator module 103 at different selective locations.

The ultrasonic sensors 103A and 13B provide readings that indicate one of three conditions for the document 103A passing between the sensors 103A and 103B: a clear condition, a blockage with a single condition (single document sensed), and a blockage with a double condition (potentially a single document with a type of fold or potential two documents that have not been properly separated).

When, the ultrasonic sensors 103A and 103B report readings from the ultrasonic sensors 103A and 13B near an end of the document 103E having a double condition, a controller for the media separator module 103 is configured to stop the transport drives (103C1, 103C2, 103D1, and 103D2). The time lag between the controller issuing the instruction to the mechanical componentry of the transport drives (103C1, 103C2, 103D1, and 103D2) to stop or halt and when the transport drives (103C1, 103C2, 103D1, and 103D2) actually mechanically stop or halt results in the document 103E traveling a small additional distance along the document's direction of travel through the media separator module 103. Two situations with respect to the document can thusly be noted.

Figure 1E:
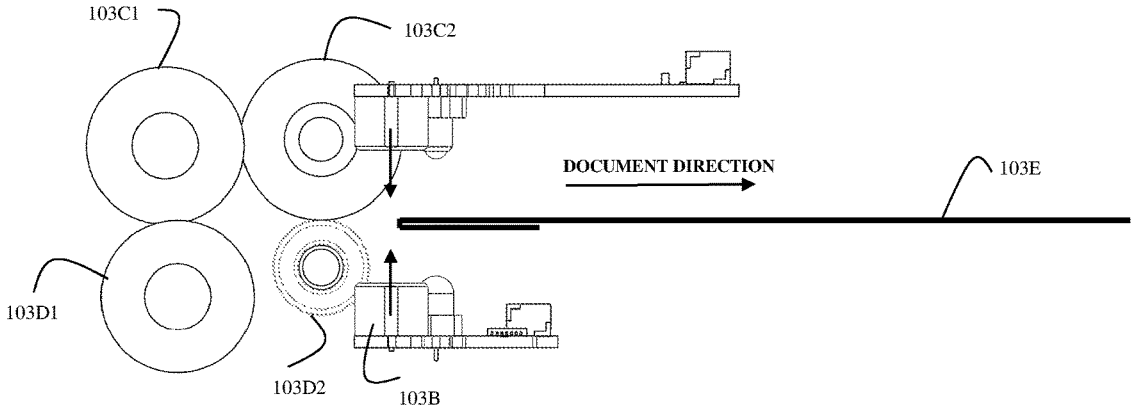
FIG. 1E is a diagram depicting a first condition of the media separator module following detection of a tail edge document fold, according to an example embodiment.

FIG. 1E is a diagram depicting a first condition of the media separator module 103 following detection of a tail edge document fold, according to an example embodiment.

The first condition represents a state or reading from the ultrasonic sensors 103A and 103B after the transport drives (103C1, 103C2, 103D1, and 103D2) actually stop after having been issued an instruction to stop by the controller of the media separator module 103 following a tail edge document fold being detected.

The first condition depicted in the FIG. 1E indicates a clear condition reported as a reading from the ultrasonic sensors 103A and 1038, meaning that document 103E is a tail edge document fold. In response to this condition, the controller activates the transport drives (103C1, 103C2, 103D1, and 103D2) to eject the document from media separator module 103.

Figure 1F:
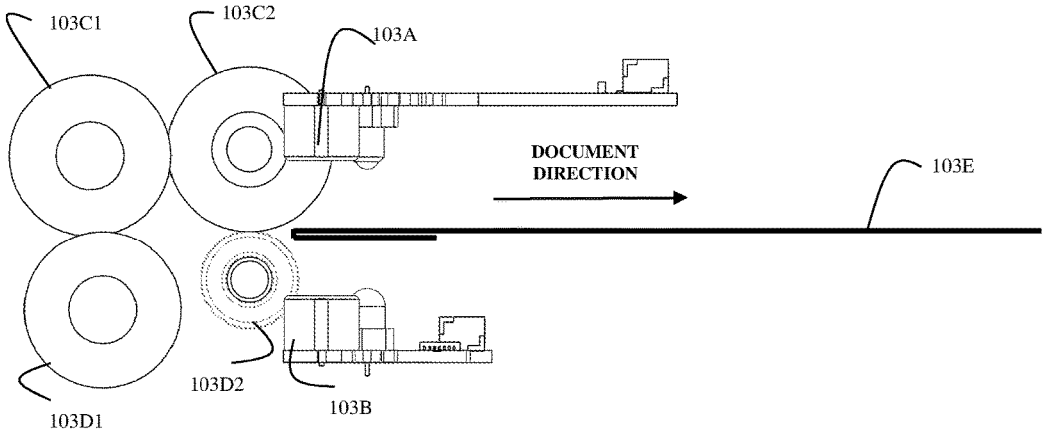
FIG. 1F is a diagram depicting a second condition of media separator module following detection of a tail edge document fold, according to an example embodiment.

FIG. 1F is a diagram depicting a second condition of media separator module 103 following detection of a tail edge document fold, according to an example embodiment.

The second condition represents a state or reading from the ultrasonic sensors 103A and 1038 after the transport drives (103C1, 103C2, 103D1, and 103D2) actually stop after having been issued an instruction to stop by the controller of the media separator module 103 following a tail edge document fold being detected.

The second condition depicted in the FIG. 1F indicates a reading from the ultrasonic sensors 103A and 1038 for a double condition. This indicates that the document 103E fold is one of: a large trail edge document fold, a mid-body document fold, or two overlapping documents that have not been separated. In this scenario, the controller of the media separator 103 performs double feed recover processing to ensure that there are not two overlapping documents still unseparated from one another.

If the second condition turns out to be a document 103E that is legitimately folded, the controller will exhaust a configured number of processing iterations of double feed recovery with no change in the ultrasonic sensor readings and a double feed failure is reported and the folded document 103E will not be fed any further downstream within the media separator 103. When the second condition is truly overlapping documents, double feed recovery processing will separate the overlapping documents and the separated documents will feed properly through the media separator module 103.

Lead Edge Document Fold

Figure 1G:
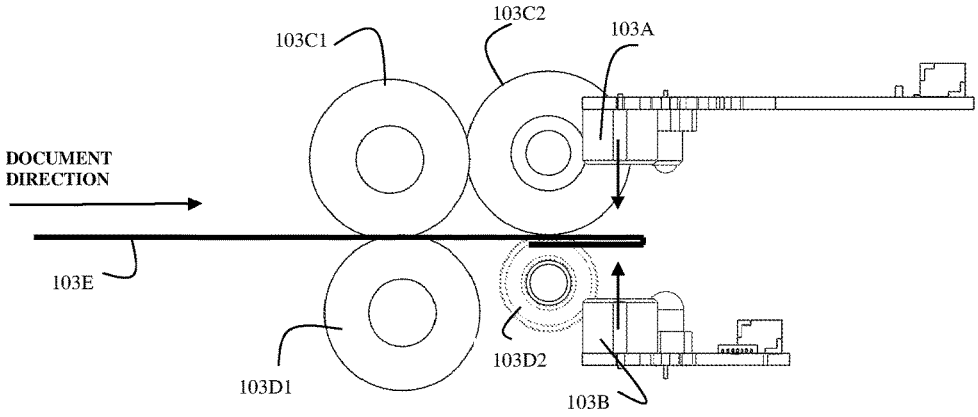
FIG. 1G is a diagram depicting a lead edge document fold within a media separator module, according to an example embodiment.

FIG. 1G is a diagram depicting a lead edge document fold within a media separator module 103, according to an example embodiment.

Here, as the initial presence of the document 103E is detected between the ultrasonic sensors 103A and 1038 the readings indicate to the controller that the document 103E was sensed with a double condition and the controller issues a halt command to the transport drives (103C1, 103C2, 103D1, and 103D2). This sensed double condition associated with the document 103E is an indication to the controller of a lead edge document fold condition or state within the media separator module 103. Again, the time between the controller issuing the stop or halt to the transport drives (103C1, 103C2, 103D1, and 103D2) and when the transport drives (103C1, 103C2, 103D1, and 103D2) actually stop results in the document 103E traveling a small distance between the ultrasonic sensors 103A and 1038, such that the reading from the ultrasonic sensors 103A and 1038 when the transport drives (103C1, 103C2, 103D1, and 103D2) have completed halted or stopped can present two additional conditions or states for the media separator module 103.

Figure 1H:
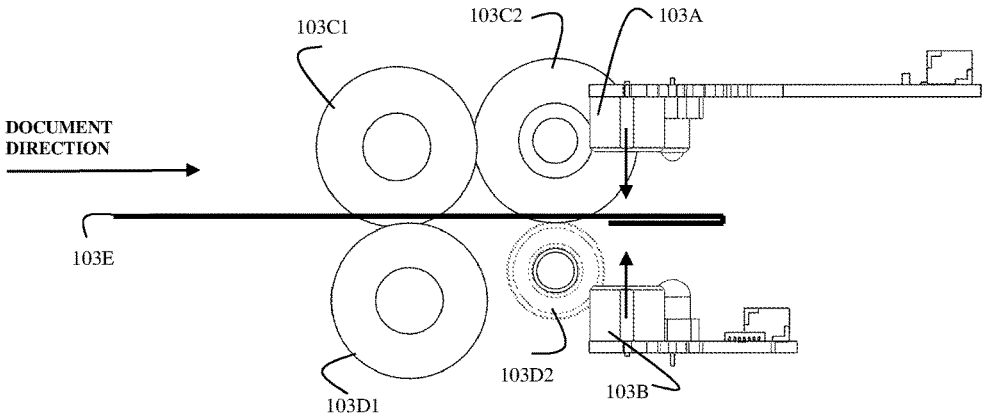
FIG. 1H is a diagram depicting a first condition of a media separator module following detection of a lead edge document fold, according to an example embodiment.

FIG. 1H is a diagram depicting a first condition of a media separator module 103 following detection of a lead edge document fold, according to an example embodiment.

The reading obtained when the transport drives (103C1, 103C2, 103D1, and 103D2) have completely stopped indicates a double condition, which indicates a first condition that document has: a large lead edge document fold, a mid-body fold, or two overlapping documents that have not been properly separated within the separator module 103. Therefore, the controller performs double feed recovery processing within the media separator module 103. When the first condition is truly overlapping documents, double feed recovery processing will separate the overlapping documents and the separated documents will feed properly through the media separator module 103. After the configured number of processing iterations of the double feed recovery is performed with still no change in the readings from the ultrasonic sensors 103A and 103B, the controller reports double feed failure and the document 103E will not be fed further downstream within the media separator module 103.

Figure 1I:
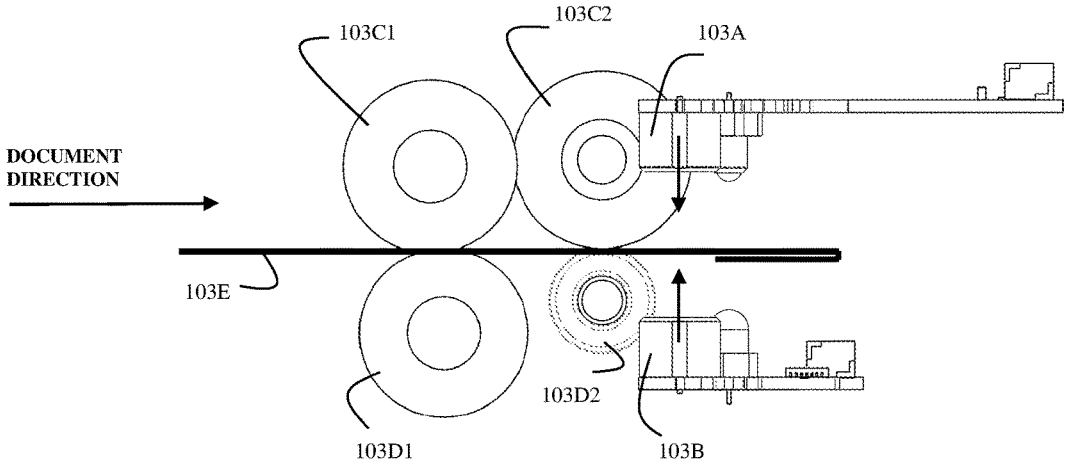
FIG. 1I is a diagram depicting a second condition of a media separator module following detection of a lead edge document fold, according to an example embodiment.

FIG. 1I is a diagram depicting a second condition of a media separator module 103E following detection of a lead edge document fold, according to an example embodiment.

The reading obtained when the transport drives (103C1, 103C2, 103D1, and 103D2) have completely stopped indicates a single condition, which indicates a second condition that document has: a small lead edge document fold, a mid-body fold, or two overlapping documents that have not been properly separated within the separator module 103. Therefore, the controller performs double feed recovery processing within the media separator module 103. When the second condition is truly overlapping documents, double feed recovery processing will separate the overlapping documents and the separated documents will feed properly through the media separator module 103. After the configured number of processing iterations of the double feed recovery is performed with still no change in the readings from the ultrasonic sensors 103A and 103B, the controller reports double feed failure and the document 103E will not be fed further downstream within the media separator module 103.

Mid-Body Document Fold

Figure 1J:
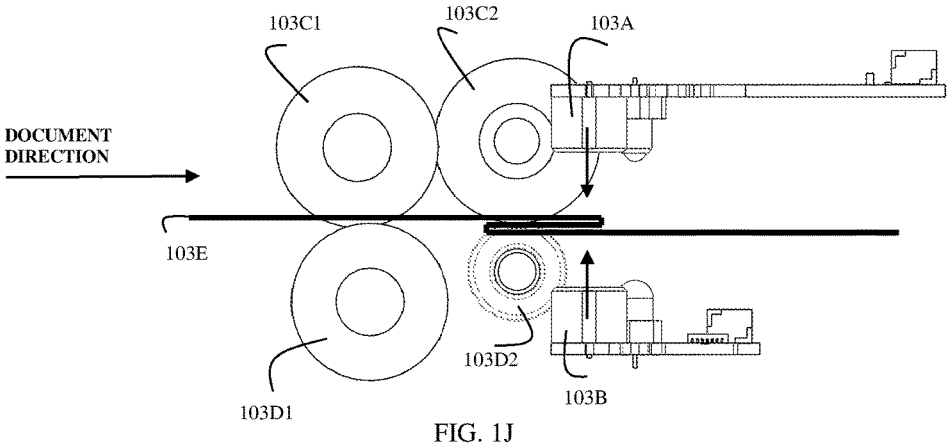
FIG. 1J is a diagram depicting a mid-body document fold within a media separator module, according to an example embodiment.

FIG. 1J is a diagram depicting a mid-body document fold within a media separator module 103, according to an example embodiment.

When the ultrasonic sensors 103A and 103B report readings after the start of the document 103E and before the end of the document 103E indicating a double condition, this situation indicates to the controller of the media separator module a mid-body document fold appearing in the document. The controller upon receiving the reading issues a stop instruction to the transport drives (103C1, 103C2, 103D1, and 103D2). A second reading from the transport drives (103C1, 103C2, 103D1, and 103D2) is obtained from the controller indicating two different conditions once the transport drives (103C1, 103C2, 103D1, and 103D2) have actually stopped or halted.

Figure 1K:
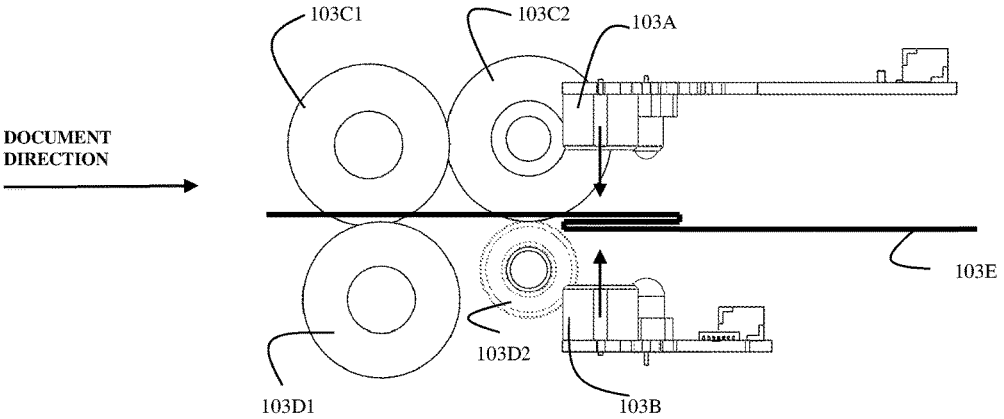
FIG. 1K is a diagram depicting a first condition of a media separator module following detection of a mid-body document fold, according to an example embodiment.

FIG. 1K is a diagram depicting a first condition of a media separator module 103 following detection of a mid-body document fold, according to an example embodiment.

If the second reading following a mid-body document fold reading from the transport drives (103C1, 103C2, 103D1, and 103D2) after actually stopping still indicates a double condition, then the controller determines that the first condition following the mid-body document fold is a condition where the document has: a large lead edge fold, a mid-body fold, or potentially two overlapping and unseparated documents. The controller performs double feed recover, resulting in documents being properly separated or a double feed recover error (as discussed above).

Figure 1L:
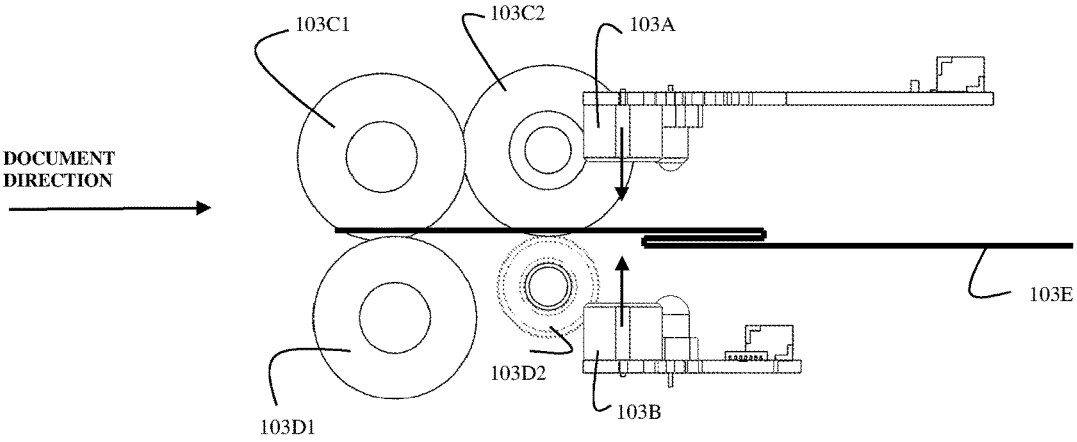
FIG. 1L is a diagram depicting a second condition of a media separator module following detection of a mid-body document fold, according to an example embodiment.

FIG. 1L is a diagram depicting a second condition of a media separator module 103 following detection of a mid-body document fold, according to an example embodiment.

If the second reading following a mid-body document fold reading from the transport drives (103C1, 103C2, 103D1, and 103D2) after actually stopping still indicates a single condition, then the controller determines that the second condition following the mid-body document fold is a condition where the document has: a small lead edge fold, a small mid-body fold, or potentially two overlapping and unseparated documents. The controller performs double feed recover, resulting in documents being properly separated or a double feed recover error (as discussed above).

New Mode of Operation for Single Document Condition

In any of the above-mentioned situations when the second reading following a controller-issued halt or stop instruction to the transport drives (103C1, 103C2, 103D1, and 103D2) indicates a document 103E having a single condition, the controller can operate the media separator module 103 in a new and novel mode of operation (an added fourth mode to the above three-mentioned conventional modes for a conventional separator module).

In the new mode of operation, the controller determines that the second reading indicates: a single document 103E with a tail edge document fold sitting half way over the ultrasonic sensors 103A and 1038, a document 103E with a mid-body document fold that has now gone past the ultrasonic sensors 103A and 1038, or overlapping and unseparated documents.

In response to this, the controller instructs the transport drives (103C1, 103C2, 103D1, and 103D2) to move forward a small and configured distance and an additional third reading is taken from the ultrasonic sensors 103A and 1038. This is not conventionally done and is a new mode of operation for the media separator module 103.

If the third reading indicates a clear condition (no document 103E detected between the ultrasonic sensors 103A and 1038 with the third reading), then the controller determines that this is a document 103E with a tail edge fold. In this situation, no further double feed recovery processing is needed at all, which minimizes further damage to the document 103E and maximizes the likelihood of the document 103E being successfully ejected from the media separator module 103.

If the third reading indicates a single or double condition, then the controller determines that this is a document 103E with a fold (large tail fold, mid-body, or lead-edge fold) and the fold has now gone further past the ultrasonic sensors 103A and 1038; a single document with multiple folds; or overlapping and unseparated documents. Here, the controller performs double feed recovery processing. If the document is really folded, double feed recovery will exhaust its retires and report double feed recovery error but the folded document 103E will not be fed for any further document 103E processing downstream within the media separator module 103. Again, if unseparated documents were detected, the documents will be separated during the double feed recovery processing and fed successfully through the media separator module 103.

As is now apparent, the configuration and processing of the media separator module 103 improves conventional media separator modules by: i) reducing fatal faults within a depository 100; ii) reducing service calls by minimizing document 103E feed retries within the media separator module 103E on folded documents and ejects folded documents before those folded documents can be fed downstream within the depository 100 to downstream document 103E processing modules; and iii) improving/enhancing processing throughput of documents through the media separator module 103 and the valuable media depository 100.

Figure 2:
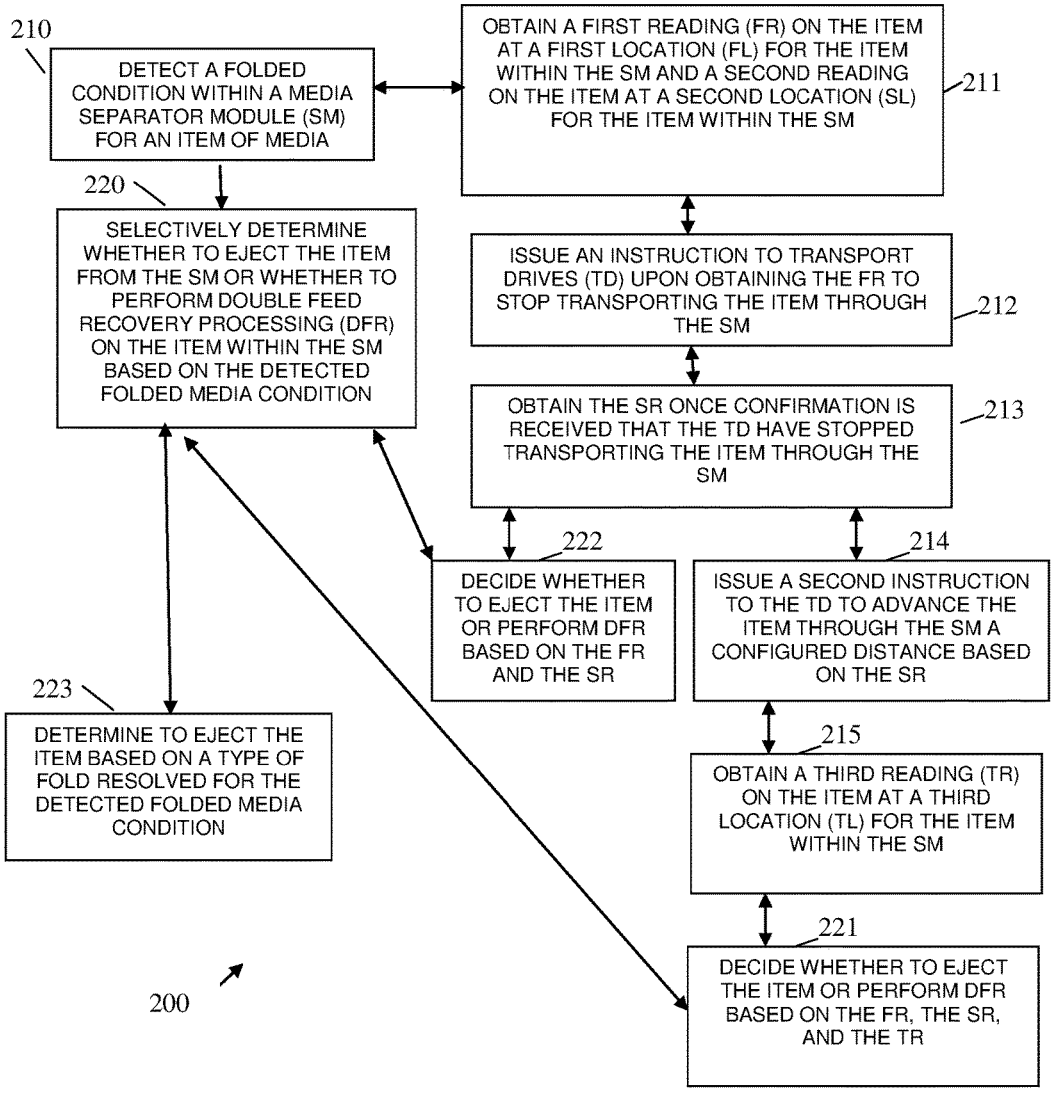
FIG. 2 is a diagram of a method for detecting and processing folded media within a media separator module, according to an example embodiment.

FIG. 2 is a diagram of a method 200 for detecting and processing folded media within a media separator module, according to an example embodiment. The method 200 when processed controls operation for a media separator module integrated into a valuable media depository. The method 200 is implemented as executed instructions representing one or more software modules referred to as folded media controller. The instructions reside in a non-transitory computer-readable medium and are executed by one or more processors of the valuable media depository.

In an embodiment, the folded media controller is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the folded media controller is the controller discussed above with the FIGS. 1B-1L.

At 210, folded media controller detects a folded media condition within a media separator module for an item of media. This detection can be achieved via the ultrasonic sensors 103A and 13B integrated within the path of travel of a document 103E (item) within the above-mentioned media separator module 103 integrated within a valuable media depository 100.

According to an embodiment, at 211, the folded media controller obtains a first reading on the item at a first location for the item within the media separator module, and the folded media controller obtains a second reading on the item at a second location for the item within the media separator module. In an embodiment, the readings are: a clear condition, a single condition, and/or a double condition as discussed above with reference to the FIGS. 1B-1L.

In an embodiment of 211 and at 212, the folded media controller issues an instruction to transport drives (electromechanical drives that engage the item to urge the item through the media separator module) upon obtaining the first reading to stop transporting the item through the media separator module. It is noted that there is a time lag between when the instruction is issued to the transport drives and when the transport drives actually physically stop or halt.

In an embodiment of 212 and at 213, the folded media controller obtains the second reading on the item at the second location once confirmation is received (or based on a configured period of elapsed time from issuing the instruction) that the transport drives have stopped transporting the item through the media separator.

In an embodiment of 213 and at 214, the folded media controller issues a second instruction to the transport drives to advance the item through the media separator module a configured distance based on the second reading. The configured distance can be achieved by starting the transport drives and quickly stopping the transport drives; that is, the configured distance can be achieved by the folded media controller rapidly starting and stopping the transport drives. This embodiment was discussed above and represents a new and novel mode of operation for the media separator module that is not available in conventional separator modules.

In an embodiment of 214 and at 215, the folded media controller obtains a third reading on the item at a third location within the separator module.

At 220. The folded media controller selectively determines whether to eject the item from the media separator module or whether to perform double feed recovery processing on the item within the separator module based on the detected folded media condition. The detected folded media conditions were discussed at length above with the descriptions of the FIGS. 1A-1L and include: clear, single, double, lead edge fold (large or small), tail edge fold (large or small), mid-body fold (large or small), multiple folds, and/or overlapping items (documents). That is, by taking conditions that the media separator provides (clear, single, double) and combining with multiple readings reporting these conditions for the item at different locations for the item within the media separator in the manners discussed herein and above, the folded media controller resolves a specific folded media condition or eliminates those folded media conditions which cannot be a situation for the item of media (leaving a smaller set of plausible folded media conditions for the item of media). This permits more efficient and accurate usage and processing of the double feed recovery processing and more accurately performs item ejection from the media separator for items of media with folds.

In an embodiment of 215 and 220, at 221, the folded media controller decides whether to eject the item or perform double feed recovery processing based on the first reading, the second reading, and the third reading. This embodiment is associated with the new processing mode of the media separator which is not conventionally done with media separators.

In an embodiment or 213 and 220, at 222, the folded media controller decides whether to eject the item or perform double feed recovery processing based on the first reading and the second reading.

In an embodiment, at 223, the folded media controller determines to eject the item based on a type of fold resolved for the detected folded media condition.

In any of the preceding embodiments the recited transport drives are the transport drives 130C1, 103C2, 103D, and/or 103D1.

Figure 3:
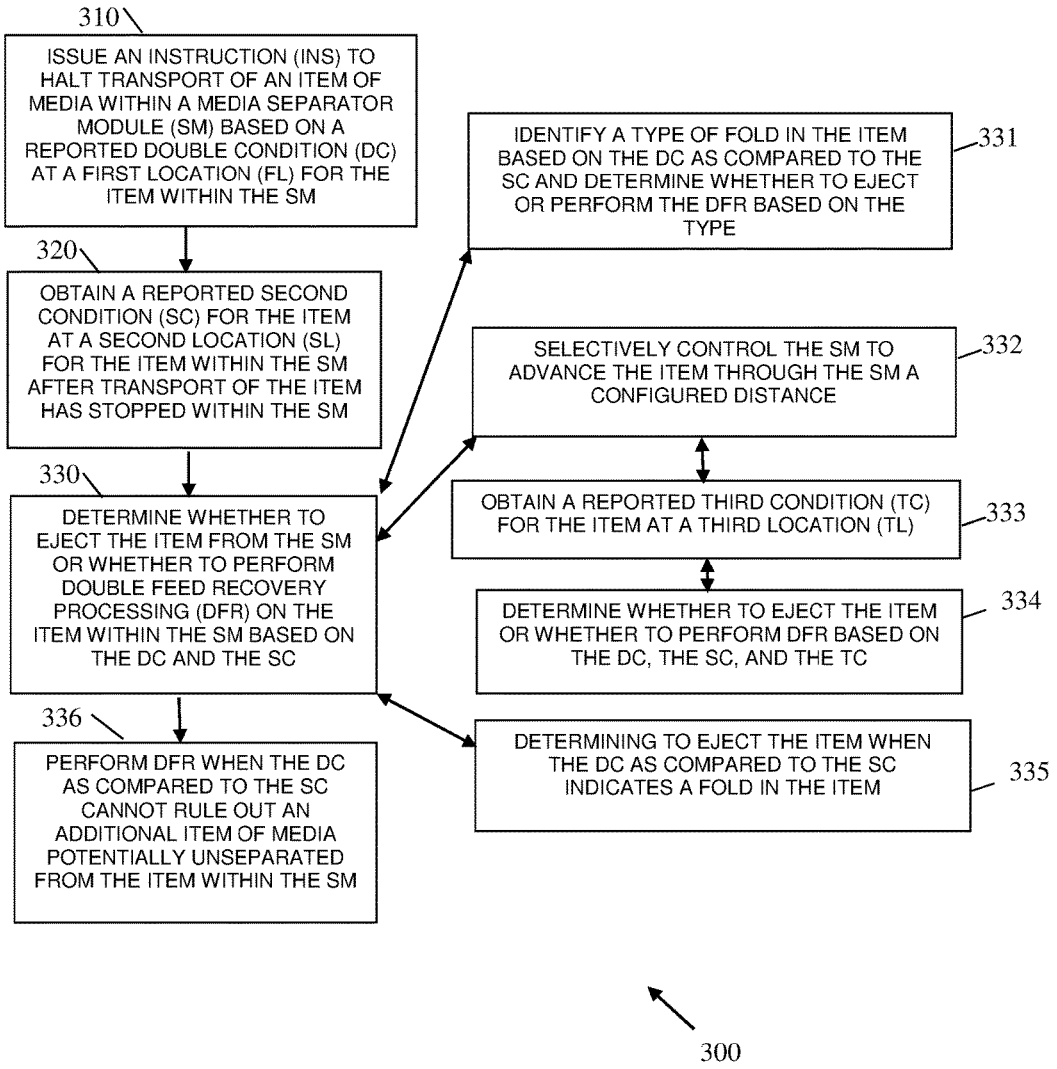
FIG. 3 is a diagram of another method for detecting and processing folded media within a media separator module, according to an example embodiment.

FIG. 3 is a diagram of another method for detecting and processing folded media within a media separator module, according to an example embodiment. The method 200 when processed controls modes of operation for a media separator module integrated into a valuable media depository. The method 200 is implemented as executed instructions representing one or more software modules referred to as a media fold manager. The instructions reside in a non-transitory computer-readable medium and are executed by one or more processors of the valuable media depository.

In an embodiment, the media fold manager is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the media fold manager is the controller and/or the folded media controller discussed above with the FIGS. 1B-1H and the FIG. 2.

In an embodiment, the media fold manager presents another and in some ways enhance perspective of the processing depicted in the method 200 (presented above with the discussion of the FIG. 2 and the folded media controller).

At 310, the media fold manager issues an instruction to halt or stop transport of an item of media within a media separator module based on a reported double condition at a first location for the item within the media separator module.

At 320, the media fold manager obtains a reported second condition for the item at a second location for the item within the separator module after transport of the item has halted or stopped within the media separator module.

At 330, the media fold manager determines whether to eject the item from the media separator module or whether to perform double feed recovery processing on the item within the media separator module based on the reported double condition and the reported second condition.

According to an embodiment, at 331, the media fold manager identifies a type of fold in the item based on the reported double condition as compared to the reported second condition and determine whether to eject the item or perform the double feed recovery processing based on the type. The type can be any of the folded conditions detected as discussed above with respect to the FIG. 2 and the processing at 220 and with respect to the types of detected folds discussed in the FIGS. 1A-1L.

In an embodiment, at 332, the media fold manager selectively controls the media separator module to advance the item through the media separator module a configured distance. This is a new mode of processing the media separator module as discussed above in the FIGS. 1A-1L and 2.

In an embodiment of 332 and at 333, the media fold manager obtains a reported third condition for the item at a third location within the media separator module after the item is moved the configured distance within the media separator module.

In an embodiment of 333 and at 334, the media fold manager determines whether to eject the item from the media separator module or whether to perform the double feed recovery processing based on the reported double condition, the reported second condition, and the reported third condition.

In an embodiment, at 335, the media fold manager determines to eject the item when the reported double condition as compared to the reported second condition indicates a fold in the item.

In an embodiment, at 336, the media fold manager performs double feed recovery processing when the reported double condition as compared to the reported second condition cannot rule out an additional item of media potentially unseparated from the item within the media separator module.

Figure 4:
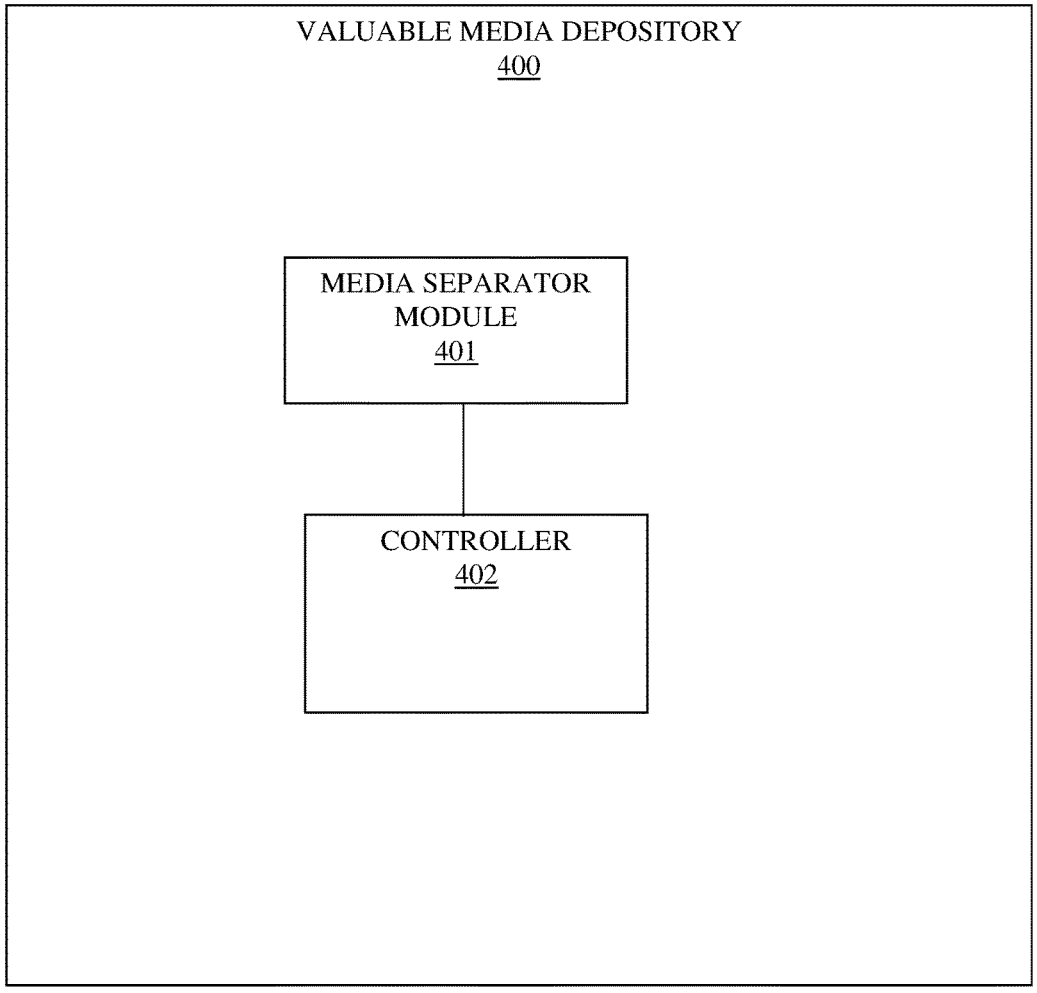
FIG. 4 is a valuable media depository, according to an example embodiment.

FIG. 4 is a media depository 400 with a media separator module, according to an example embodiment. The valuable media depository 400 processes valuable media and includes a variety of mechanical, electrical, and software/firmware components, some of which were discussed above with reference to the FIGS. 1A-1H and the FIGS. 2-3.

In an embodiment, the valuable media depository 400 is a deposit module.

In an embodiment, the valuable media depository 400 is a recycler module.

In an embodiment, the valuable media depository 400 is the depository 100.

In an embodiment, the valuable media depository 400 is the depository that performs any of the methods 150, 200, and 300 of the FIGS. 1H and 2-3.

In an embodiment, the valuable media depository 400 is a peripheral device integrated into an SST. In an embodiment, the SST is an ATM. In an embodiment, the SST is a kiosk.

In an embodiment, the valuable media depository 400 is a peripheral device integrated into a Point-Of-Sale (POS) terminal.

The valuable media depository 400 includes a media separator module 401 including a controller 402 operable to control the media separator module 401.

The controller 402 is configured to: i) selectively control movement of an item of media through the media separator module 401, ii) obtain readings for the item at selective locations within the media separator module 401, and iii) determine whether to eject the item from the media separator module 401 or perform double feed recovery processing on the item within the media separator module 401 based on the readings.

In an embodiment, the controller 402 drives the electromechanical components of the media separator module 103 as discussed in the FIGS. 1 B-1H and the FIGS. 2-3.

In an embodiment, the controller 402 is the controller discussed above with reference to the FIGS. 1A-1L.

In an embodiment, the controller 402 is the method 200 of the FIG. 2.

In an embodiment, the controller 402 is the method 300 of the FIG. 3.

In an embodiment, the controller 402 performs all or some combination of the processing performed by: the controller discussed above with reference to the FIGS. 1A-1L, the method 200, and the method 300.

In an embodiment, the controller 402 is further configured to perform a configured number of processing iterations for the double feed recovery processing within the media separator module 401 after which the controller 402 is configured to eject the item from the media separator module 401 when the item is unsuccessfully processed through the media separator module 401.

In an embodiment, the controller 402 is further configured to halt transport of the item within the media separator module 401 and advance the item a configured distance within the media separator module 401 after the halt for further inspection. This represents a new and novel mode of processing for the media separator module 401 as discussed above with reference to the FIGS. 1A-1L, 2, and 3.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

detecting a folded media condition using a media thickness sensor within a media separator module for an item of media; and selectively determining whether to eject the item from the media separator module or whether to perform double feed recovery processing on the item within the media separator module based on the detected folded media condition.

2. The method of claim 1, wherein detecting further includes obtaining from the media thickness sensor a first reading on the item of media at a first location of the item along a transport path within the media separator module and a second reading on the item of media at a second location of the item along the transport path within the media separator.

3. The method of claim 2, wherein obtaining further includes issuing an instruction to transport drives upon obtaining the first reading to stop transporting the item through the media separator module.

4. The method of claim 3, wherein issuing further includes obtaining the second reading once a confirmation is received that the transport drives have stopped transporting the item through the media separator module.

5. The method of claim 4 further comprising, issuing a second instruction to the transport drives to advance the item through the media separator module a configured distance based on the second reading.

6. The method of claim 5, wherein issuing the second instruction further includes obtaining from the media thickness sensor a third reading on the item at a third location of the item along the transport path within the media separator module.

7. The method of claim 6, wherein selectively determining further includes deciding whether to eject the item or perform the double feed recovery processing based on the first reading, the second reading, and the third reading.

8. The method of claim 4, wherein selectively determining further includes deciding whether to eject the item or perform the double feed recovery processing based on the first reading and the second reading.

9. A method, comprising:

issuing an instruction to halt transport of an item of media within a media separator module based on a reported double condition from a media thickness sensor at a first location of the item along a transport path within the media separator module;

obtaining a reported second condition from the media thickness sensor for the item at a second location of the item along the transport path within the media separator module after transport of the item has stopped within the media separator module;

determining from the reported double condition and the reported second condition that the double condition is a folded media condition; and determining whether to eject the item from the media separator module or whether to perform double feed recovery processing on the item within the media separator module based on the determined folded media condition.

10. The method of claim 9, wherein determining whether to eject the item from the media separator module or whether to perform double feed recovery processing on the item further includes determining to eject the item when the reported second condition is a clear condition.

11. The method of claim 9, wherein determining further includes selectively controlling the media separator module to advance the item through the media separator module a configured distance.

12. The method of claim 11, wherein selectively controlling further includes obtaining a reported third condition from the media thickness sensor of the item at a third location along the transport path.

13. The method of claim 12, wherein obtaining further includes determining whether to eject the item or whether to perform double feed recovery based on the reported double condition, the reported second condition, and the reported third condition.

14. The method of claim 9, wherein determining further includes determining to perform the double feed recovery processing when the second condition is another reported double feed condition.

15. A depository, comprising:

a media separator module; and a controller operable to control the media separator module;

wherein the controller is configured to: i) selectively control movement of an item of media through the media separator module, ii) obtain first and second readings from a media thickness sensor of the item at selective locations along a transport path within the media separator module, iii) determine from the first and second readings that the item has a folded media condition and iv) determine whether to eject the item from the media separator module or perform double feed recovery processing based on the folded media condition.

16. The depository of claim 15, wherein the controller is further configured, in iii), to: perform a configured number of iterations for the double feed recovery processing after which the item is ejected from the media separator module if the item is unsuccessfully processed through the media separator module.

17. The depository of claim 15, wherein the controller is further configured, in i). to: halt transport of the item and advance the item a configured distance within the media separator module after the halt.

18. The depository of claim 15, wherein the depository is one of: a deposit module and a recycler module.

19. A method, comprising:

detecting a folded media condition using a media thickness sensor within a media separator module for an item of media including:

obtaining from the media thickness sensor a first reading on the item of media at a first location of the item along a transport path within the media separator module;

issuing an instruction to transport drives upon obtaining the first reading to stop transporting the item through the media separator module; and obtaining from the media thickness sensor a second reading on the item of media at a second location of the item along the transport path within the media separator module once a confirmation is received that the transport drives have stopped transporting the item through the media separator module; and selectively determining whether to eject the item from the media separator module or whether to perform double feed recovery processing on the item within the media separator module based on the detected folded media condition.

20. The method of claim 19 further comprising, issuing a second instruction to the transport drives to advance the item through the media separator module a configured distance based on the second reading.

21. The method of claim 20, wherein issuing the second instruction further includes obtaining from the media thickness sensor a third reading on the item at a third location for the item within the media separator module.

22. The method of claim 20, wherein selectively determining further includes deciding whether to eject the item or perform the double feed recovery processing based on the first reading, the second reading, and the third reading.

23. A method, comprising:

obtaining from the media thickness sensor a first reading on the item of media at a first location of the item along a transport path within the media separator module and a second reading on the item of media at a second location of the item along the transport path within the media separator;

determining that one of a plurality of folded media conditions exists based upon the first and second readings;

obtaining from the media thickness sensor a third reading on the item of media at a third location of the item of media along the transport path within the media separator module to identify the one folded media condition; and determining whether to eject the item of media from the media separator module or whether to perform double feed recovery processing on the item of media within the media separator module based on the identified one folded media condition.

* * * * *